United States Patent [19]

Kawakami et al.

[11] 4,147,505

[45] Apr. 3, 1979

[54] APPARATUS FOR SCRAPING AWAY SUBSTANCES ADHERING TO INNER WALL OF ROTARY KILN

[75] Inventors: Sigezo Kawakami; Kunihiko Tsuji, both of Kobe; Hiroshi Omura, Kakogawa; Hisai Ishizuka, Kobe, all of Japan

[73] Assignee: Kobe Steel, Ltd., Kobe, Japan

[21] Appl. No.: 785,961

[22] Filed: Apr. 8, 1977

[30] Foreign Application Priority Data

Apr. 9, 1976 [JP] Japan ..... 51-40667

[51] Int. Cl.[2] ..... F27B 7/14

[52] U.S. Cl. ..... 432/118; 235/91 R; 235/132 R; 432/2

[58] Field of Search ..... 432/118, 2, 266

[56] References Cited

U.S. PATENT DOCUMENTS 2,666,633 1/1954 Bojner ..... 432/118 X

*Primary Examiner*—Martin P. Schwadron
*Assistant Examiner*—Richard Gerard
*Attorney, Agent, or Firm*—Oblon, Fisher, Spivak, McClelland & Maier

[57] ABSTRACT

Apparatus for performing operations of agitating a material to be treated in a rotary kiln and scraping away substances adhering to the inner wall of the rotary kiln effectively at a high efficiency so as to operate the rotary kiln continuously for a long time and perform the heat treatment in the rotary kiln very smoothly.

The apparatus includes a cylindrical cage having openings enabling a material to be treated to pass therethrough in both the axial direction and the radial direction, the cage including a supporting frame and a plurality of plate members extending in the axial direction of a kiln proper and being arranged at prescribed intervals on the outer periphery of the supporting frame, the cage having a diameter smaller than the inner diameter of the kiln proper and being inserted in the kiln proper in such a state that at least one of the plate members is contacted with the inner face of the kiln proper so that the cage is freely rotated with rotation of the kiln proper, and stop means engaged with a part of the cage to intermittently stop the rotation of the cage.

7 Claims, 5 Drawing Figures

APPARATUS FOR SCRAPING AWAY SUBSTANCES ADHERING TO INNER WALL OF ROTARY KILN

BACKGROUND OF THE INVENTION

1. Field of the Invention

The present invention relates to an apparatus for scraping away substances adhering to the inner wall of a rotary kiln so as to perform the operation of the rotary kiln continuously for a long time and enhance the operation efficiency of the rotary kiln.

2. Description of the Prior Art

When rubbery or plastic materials or city garbage are thermally decomposed by using a rotary kiln or when coal is carbonized or various materials are dried in a rotary kiln, and other substances are accumulated on the inner wall of the rotary kiln to form a layer with the lapse of time and such layer has bad influences on the operation. Especially in case of a rotary kiln of the external heating type, transfer of heat through the wall of the rotary kiln is drastically inhibited by such layer of adhering substances and hence, the operation becomes impossible in a short time. Accordingly, in order to perform the operation continuously, it is necessary to remove substances adhering to the inner wall of the rotary kiln.

As the conventional apparatus for agitating a material to be treated in a rotary kiln and preventing the material from adhering to the inner wall of the rotary kiln, there can be mentioned apparatuses illustrated in the specifications of U.S. Pat. No. 3,245,154 and U.S. Pat. No. 3,333,837. In these conventional apparatuses, however, since the apparatuses per se are continuously rotated while the rotary kiln is being rotated, and since they fall in contact with the inner face of the rotary kiln only by virtue of their own weights, there are brought about various disadvantages. For example, slips are readily caused on the rotation of the apparatus with increase of the substances adhering to the inner wall of the rotary kiln or by the adhering force of the accumulated substances, and the apparatus rotates on the layer of the substances adhering to the inner wall of the rotary kiln and presses strongly the adhering substances to the inner wall of the rotary kiln. Accordingly, removal of the adhering substances cannot be accomplished at a high efficiency or completely, and therefore, the heat transfer efficiency is degraded in the rotary kiln.

SUMMARY OF THE INVENTION

It is a primary object of the present invention to provide an apparatus which enables a long-time continuous operation of a rotary kiln and a smooth heat treatment by the rotary kiln by supplying heat to a material to be treated uniformly at a high efficiency.

Another object of the present invention is to provide an apparatus which can agitate effectively a material to be treated in a rotary kiln and scrape away substances adhering to the inner wall of the rotary kiln effectively.

In accordance with the first aspect of the present invention attaining the foregoing objects, there is provided an apparatus for scraping away substances adhering to the inner wall of a rotary kiln, which includes (A) a cylindrical cage having openings enabling a material to be treated to pass therethrough in both the axial direction and radial direction, the cage including (1) a supporting frame and (2) a plurality of plate members extending in the axial direction of a kiln proper and being arranged at prescribed intervals on the outer periphery of the supporting frame, the cage having a diameter smaller than the inner diameter of the kiln proper and being inserted in the kiln proper in such a state that at least one of the plate members is contacted with the inner face of the kiln proper so that the cage is freely rotated with rotation of the kiln proper, and (B) stop means engaged with a part of the cage to intermittently stop the rotation of the cage.

In accordance with the second aspect of the present invention, there is provided an apparatus as set forth in the first aspect which further includes timer means for controlling the operation of the stop means.

In accordance with the third aspect of the present invention, there is provided an apparatus as set forth in the first aspect which further includes a rotation number detecting mechanism for detecting the rotation number of the cage, means for storing the rotation number of the cage detected by the rotation number detecting mechanism and a control device for controlling the operation of the stop means co-operatively with the storing means.

In accordance with the fourth aspect of the present invention, there is provided an apparatus as set forth in the first aspect wherein the cage includes a plurality of pins arranged annularly on the terminal end portion thereof so that said pins are engaged with said stop means to stop the rotation of the cage.

In accordance with the fifth aspect of the present invention, there is provided an apparatus as set forth in the first aspect wherein the plate members are inclined in the direction of the rotation of the cage with respect to the radial direction of the cage.

In accordance with the sixth aspect of the present invention, there is provided an apparatus as set forth in the first aspect which further includes means for preventing the cage from moving in the axial direction of the kiln proper.

In accordance with the seventh aspect of the present invention, there is provided an apparatus as set forth in the first aspect wherein the stop means includes a rod member engaged with a part of the cage to stop the rotation of the cage, a cylinder member for moving the rod member reciprocatively and control means for performing the reciprocative movement of the rod member periodically.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or similar parts throughout the several views, and wherein.

DETAILED DESCRIPTION OF THE PREFERRED EMBODIMENTS

Figure 1:
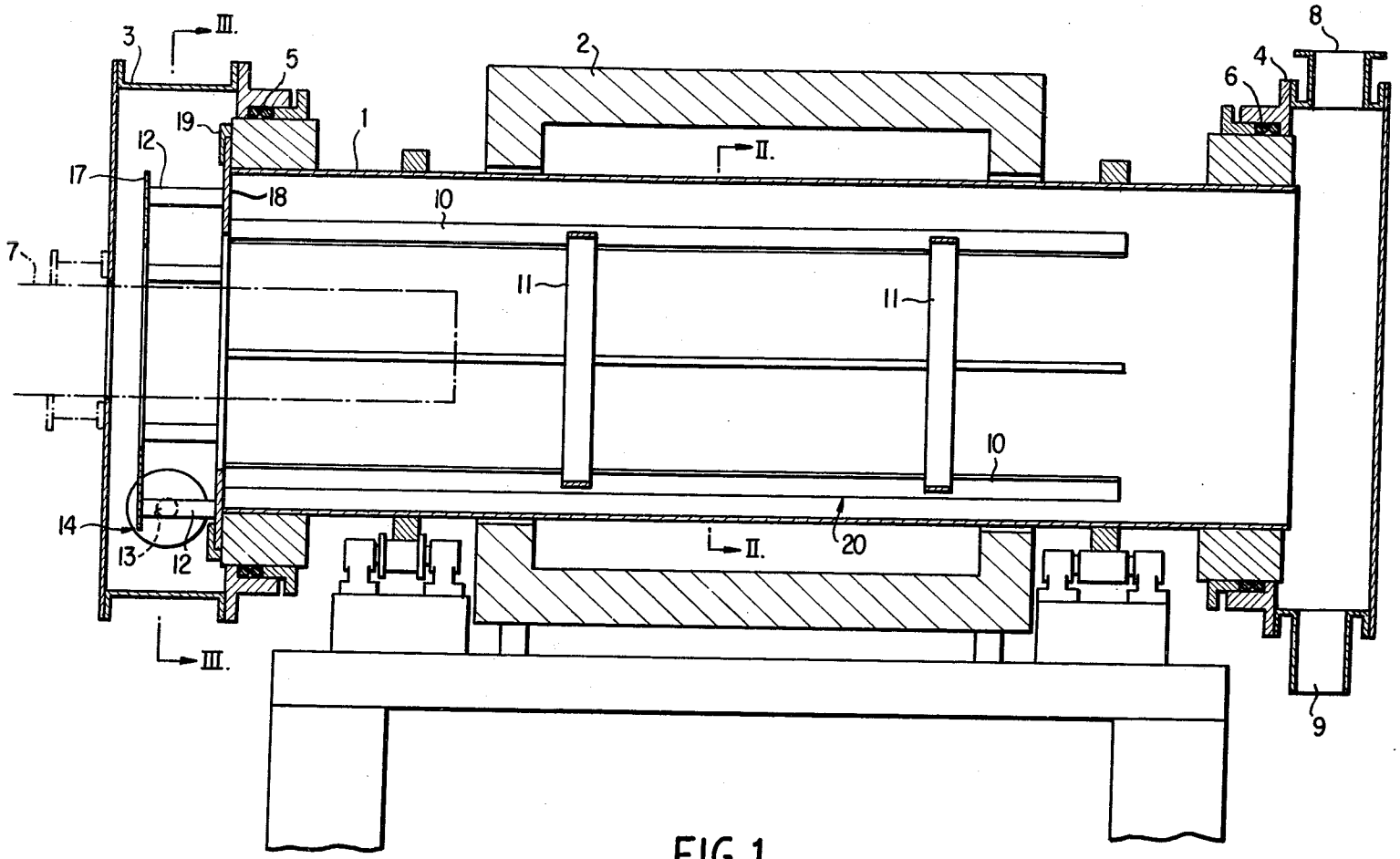
FIG. 1 is a longitudinally sectional view illustrating one embodiment of the apparatus of the present invention.
Figure 2:
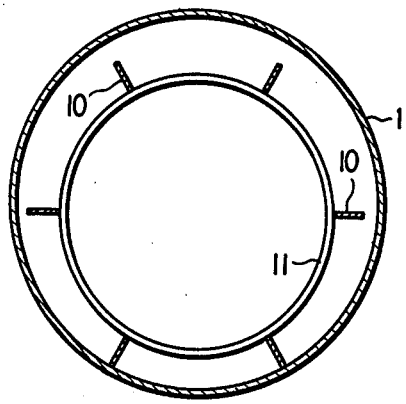
FIG. 2 is a view showing the section taken along the line II-II in FIG. 1.

The present invention is first described by reference to FIG. 1 illustrating one embodiment of the apparatus.

Reference numeral 1 represents a rotary kiln proper, and the rotary kiln proper 1 is heated from the outside by a heating furnace 2. Reference numerals 3 and 4 represent a front cover and a rear cover, respectively, and packings 5 and 6 are formed on parts connecting the covers 3 and 4 to the kiln 1 to insulate the kiln 1 from outer air. Reference numerals 7, 8 and 9 represent a raw material feed device, an exhaust gas opening and an opening for discharging char and residues, respectively. A cage 20 includes an annular supporting frame 11 and a plurality of plate members 10 (six plate members in FIG. 1) extending in the lengthwise direction of the kiln 1. These plate members 10 are attached to the cage 20 at prescribed intervals in the circumferential direction by the supporting frame 11 so that a material to be treated is allowed to pass through the cage 20. In this state, the cage 20 is inserted into the kiln 1 so that it is freely rotated with rotation of the kiln 1. A plurality of pins 12 are arranged on the front end portion of the cage 20 in the circumferential direction and both the end portions of the respective pins 12 are connected to one another by means of annular plates 17 and 18. Plates 10 are secured to annular plate 18 which is rotatably mounted in a fixed bearing guide 19. In this arrangement, by fitting the outer peripheral portion of the annular plate 18 into the guide 19, the cage 20 is rotated at a certain position. Further, at least one of the plate members 10 of the cage 20 is pressed to the inner face of the kiln 1 entirely along the lengthwise direction by the weight of the cage 20. The shape of the plate member 10 need not always be linear as shown in FIG. 1 but it may have a spiral or other shape so far as the top end thereof is entirely contacted with the inner face of the kiln 1.

Figure 3:
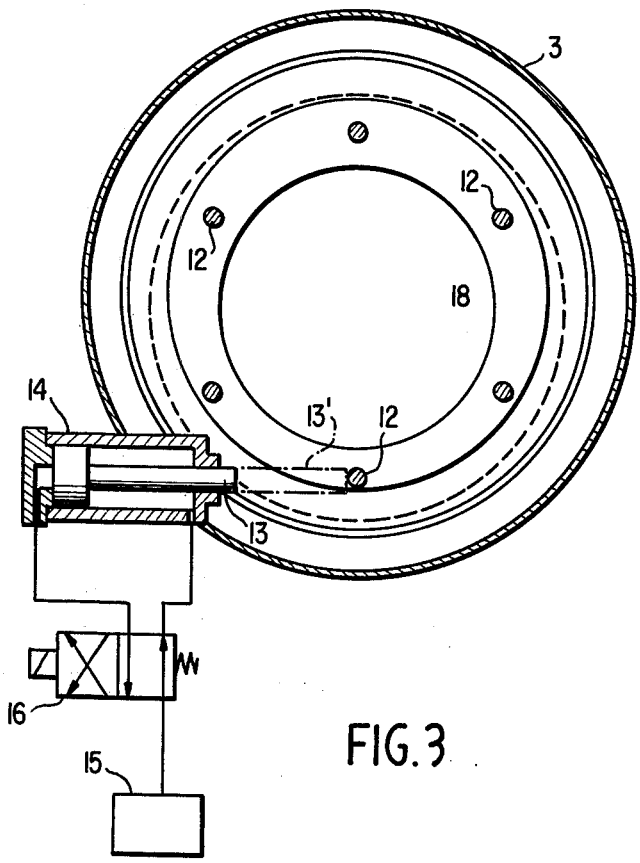
FIG. 3 is a view showing the section taken along the line III-III in FIG. 1.

The left end portion of FIG. 1 and FIG. 3 illustrate one example of stop means for intermittently stopping rotation of the cage 20. Reference numeral 14 represents a fluid cylinder wanted in the front cover 3. When this fluid cylinder 14 is actuated, the top end of a piston rod 13 is caused to fall in contact with the pins 12. This fluid cylinder 14 is actuated by a compressed fluid generating device 15 and the operation of the fluid cylinder 14 is controlled by a solenoid valve 16.

The operation of the apparatus having the above structure will now be described.

First, the piston rod 13 is retracted as indicated by a solid line in FIG. 3, and a material is fed into the kiln 1 and the kiln 1 is rotated while it is heated by the heating furnace 2. With rotation of the kiln 1, also the cage 20 is rotated. Since the outer diameter of the cage 20 is slightly smaller than the inner diameter of the kiln 1, the cage 20 is freely turned in the kiln 1. Further, since the annular plate 18 is rotated in the top end portion of the cage 20 in the state fitted to the guide 19, the cage 20 is rotated without moving in the axial direction of the kiln 1. In this state, the fluid cylinder 14 is actuated to project the piston rod 13 to a position 13'. At this moment, the pins 12 of the rotating cage 20 are caused to fall in contact with the top end portion of the piston rod 13, whereby the rotation of the cage 20 is stopped. Since the kiln 1 continues the rotation, sliding contact is caused between the inner face of the kiln and the plate member 10 pressed to the inner face of the kiln, whereby the plate member 10 exerts a function of scraping away substances adhering to the inner face of the kiln. When the piston rod 13 is then retracted, the rotation-inhibiting force on the cage 20 is released and the cage 20 is rotated again with rotation of the kiln 1. Thus, the rotation of the cage is inhibited while the piston rod 13 is projected and during this period, substances adhering to the inner face of the kiln are scraped away. Accordingly, during this scraping operation, agitation of the material in the kiln is inhibited. Therefore, the operation time of the piston rod 13 is set to such a short time as having no bad influences on agitation of the material and the piston rod 13 is intermittently actuated at a short operation interval. This operation interval of the piston rod 13 and the number of the plate members 10 are determined so that the scaping action is uniformly effected on the entire inner face of the kiln.

Since substances adhering to the inner face of the kiln are always scraped away and prevented from accumulation by such scraping action, even if the kiln is operated for a long time continuously, the state at the initial stage of the operation can be maintained in the kiln.

Moreover, with rotation of the cage, the plate members 10 have not only the above scraping function but also a function of dipping up the material in the bottom portion of the kiln and bring it down gradually. Accordingly, a good agitation effect can be attained and heat is supplied uniformly to the material at a high efficiency while preventing agglomeration of the material.

Figure 4:
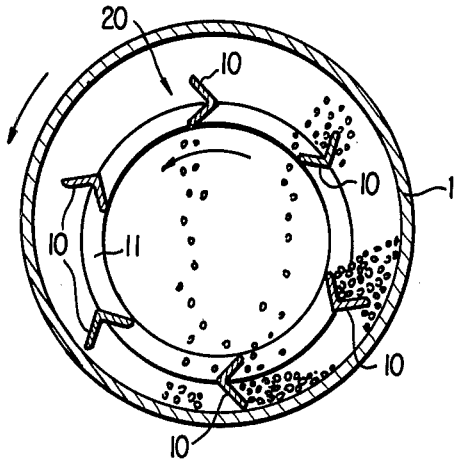
FIG. 4 is a cross-sectional view showing another embodiment of the apparatus of the present invention.

It is preferred that the plate members 10 be attached to the supporting frame 11 in the state inclined in the rotation direction of the cage 20 with respect to the radial direction of the cage as shown in FIG. 4. By this arrangement, the material to be treated is further lifted up in the rotary kiln and is agitated more effectively.

According to the present invention, by stopping the cage 20 intermittently and causing the plate members 10 to have sliding contact with the inner face of the kiln proper 1 in the above-mentioned manner, substances adhering to the inner face of the kiln proper 1 can be scraped away assuredly. However, in view of agitation of the material to be treated, it is necessary to rotate and stop the cage 20 intermittently and periodically at certain intervals. Rotation and stopping of the cage 20 may be periodically effected manually by using suitable time measuring means. However, in view of the operation efficiency, it is preferred that rotation and stopping of the cage be automatically controlled. As means enabling such automatic control, there can be mentioned timer means. An embodiment using timer means will now be described.

The predetermined rotation time and stopping time of the cage 20 are stored in timer means, and outputs of the timer means are transmitted in succession to the solenoid valve 16, the compressed fluid generating device 15 and the fluid cylinder 14 in the embodiment shown in FIG. 1 to control the time during which the piston rod 13 falls in contact with the pins 12 or is kept separated from the pins 12, whereby rotation and stopping of the cage 20 are automatically performed periodically at prescribed intervals.

Figure 5:
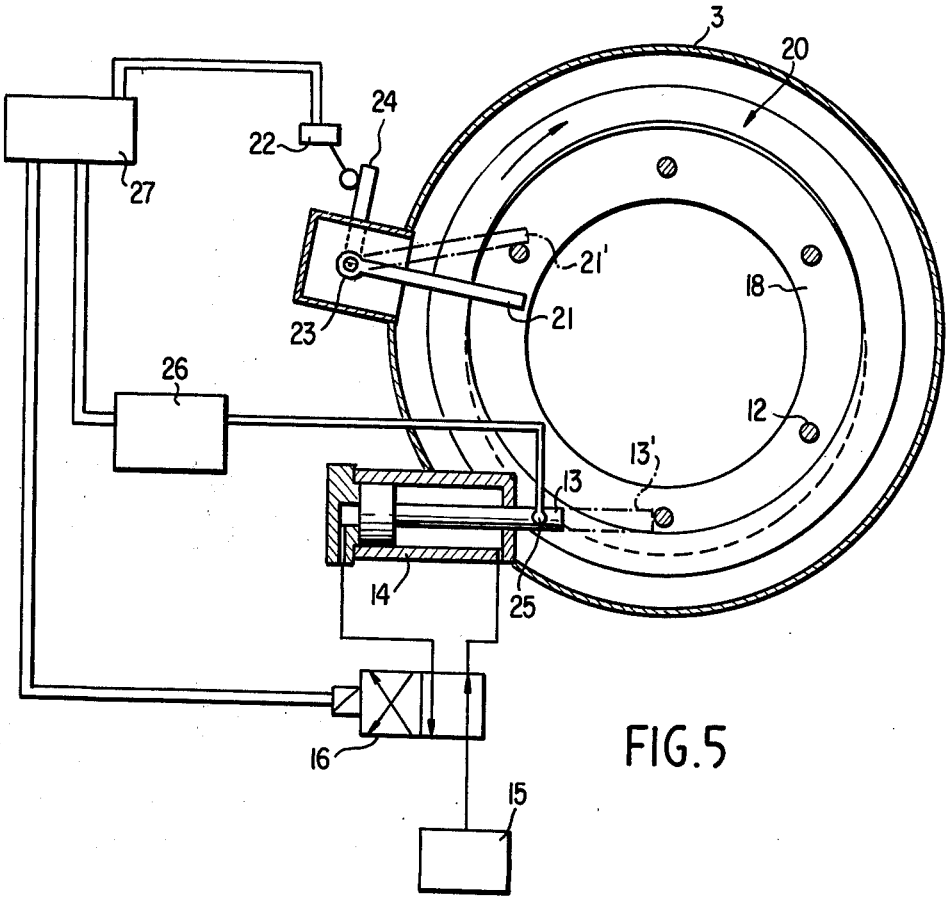
FIG. 5 is a view illustrating one example of a device for performing rotation of the cage intermittently in the apparatus of the present invention.

In the foregoing embodiment, timer means for performing automatically rotation and stopping of the cage periodically at prescribed intervals by using the time as the control element is employed. In addition to such timer means, there may be employed means for performing automatically rotation and stopping of the cage periodically by using the rotation number of the cage as the control element. An embodiment using such control means will now be described by reference to FIG. 5.

A counting lever 21 is disposed to pierce the front cover 3 so that the top end of the counting lever 21 falls in contact with the pins 12 when the kiln is rotated. A limit switch 22 is disposed to have contact with a contact element 24 fixed to a shaft 23 supporting the counting lever 21. A strain gauge 25 for measuring the load of the stopper is connected to a recorder described hereinafter. The recorder 26 for recording the load of the stopper and the operation time of the stopper is connected to a counter type control device 27.

When the cage 20 is rotated with rotation of the kiln proper 1, the lever 21 falls in contact with the pins 12, and when the lever 21 is swung to a position 21' by the contact with the pins 12, the contact element 24 following the rotating lever 21 falls in contact with the limit switch 22 to actuate it to detect the rotation number of the cage 20 in the form of pulses. The lever 21 is immediately returned to the original position.

The pulses indicating the rotation of the cage 20 are counted by a preset counter of the counter type control device 27, and when the counted value of the input signals arrives at a prescribed number, the output signal fed to the solenoid valve 16 is adjusted. When the solenoid valve 16 is thus actuated to project the piston rod 13 as the stopper to the position 13', the pins 12 of the cage 20 fall in contact with the top end portion of the rod 13, whereby rotation of the cage 20 is stopped. Since the kiln 1 continues rotation, sliding contact is caused between the inner wall of the kiln 1 and the top ends of the plate members 10 pressed to the inner face of the kiln 1, and substances adhering to the inner face of the kiln are scraped away by the plate members 10 as shown in FIG. 4.

When the solenoid valve 16 is then de-energized by a timer of the counter type control device 27, the piston rod 13 is returned to the original position from the position 13' and the rotation inhibiting force on the cage 20 is released. Accordingly, the cage 20 is rotated again with rotation of the kiln 1.

In the foregoing manner, the cage 20 is intermittently stopped according to the predetermined value of the rotation number and this intermittent stopping is repeated.

Further, in this embodiment, it can be confirmed whether the scraping operation is being performed normally, by recording the load imposed on the piston rod 13 during stopping of the cage 20, the value counted by the lever 21 and the operation time of the piston rod by the strain gauge 25 disposed between the fluid cylinder 14 and the piston rod 13 and the recorder 26.

Of course, the lever for detecting the rotation number of the cage, the limit switch, the counter, the timer and the like member in the foregoing embodiment may be replaced by other means or units capable of attaining the same objects.

In the foregoing embodiments, the specific stop means is applied to a kiln of the external heating type. Of course, the present invention may be applied to a rotary kiln of the internal heating type and various modifications may be made to the stop means specifically illustrated in the foregoing embodiments.

Further, the apparatus of the present invention may be applied to not only a kiln for thermal decomposition of rubbery and plastic materials, city garbage and the like but also other kilns involving a problem of adhesion of substances to the inner wall of the kiln, for example, those for carburization of coal or drying, burning or calcining other various materials.

As will be apparent from the foregoing illustration, according to the present invention, operations of agitating a material to be treated in a rotary kiln and scraping away substances adhering to the inner wall of the kiln proper can be accomplished at a high efficiency effectively by inserting in the kiln proper a cage capable of rotating with rotation of the kiln proper and stopping the rotation of the cage intermittently manually or automatically by using time measuring means or rotation number detecting means, whereby the rotary kiln can be operated continuously for a long time and the heat treatment can be performed smoothly. Thus, various industrial advantages can be attained by the present invention. Obviously, numerous modifications and variations of the present invention are possible in light of the above teachings. It is therefore to be understood that within the scope of the appended claims, the invention may be practiced otherwise than as specifically described herein.

What is claimed is:

1. An apparatus for scraping away substances adhering to the inner wall of a rotary kiln, which comprises (A) a cylindrical cage having openings enabling a material to be treated to pass therethrough in both the axial direction and radial direction, said cage including (1) a supporting frame and (2) a plurality of plate members extending in the axial direction of a kiln proper and being arranged at prescribed intervals on the outer periphery of said supporting frame, said cage having a diameter smaller than the inner diameter of the kiln proper, (B) means for mounting the cage in the kiln proper such that at least one of said plate members is contacted with the inner face of the kiln proper so that the cage is freely rotated with rotation of the kiln proper, said means further mounting said cage such that the kiln may rotate relative to the cage, and (C) stop means engaged with a part of said cage to intermittently stop the rotation of the cage.

2. An apparatus as set forth in claim 1 which further comprises timer means for controlling the operation of said stop means.

3. An apparatus as set forth in claim 1 which further comprises a rotation number detecting mechanism for detecting the rotation number of said cage, means for storing said rotation number of said cage detected by said rotation number detecting mechanism and a control device for controlling the operation of said stop means co-operatively with said storing means.

4. An apparatus as set forth in claim 1 wherein said cage comprises a plurality of pins arranged annularly on the terminal end portion thereof so that said pins are engaged with said stop means to stop the rotation of said cage.

5. An apparatus as set forth in claim 1 wherein said plate members are inclined in the direction of the rotation of said cage with respect to the radial direction of the cage.

6. An apparatus as set forth in claim 1 which further comprises means for preventing said cage from moving in the axial direction of said kiln proper.

7. An apparatus as set forth in claim 1 wherein said stop means includes a rod member engaged with a part of said cage to stop the rotation of the cage, a cylinder member for moving said rod member reciprocatively and control means for performing the reciprocative movement of said rod member periodically.

* * * * *